US008454331B2

(12) United States Patent
Ford

(10) Patent No.: US 8,454,331 B2
(45) Date of Patent: Jun. 4, 2013

(54) PLATE PUMP ASSEMBLY FOR USE WITH A SUBSURFACE PUMP

(76) Inventor: Michael Brent Ford, St. George, UT (US)

( * ) Notice: Subject to any disclaimer, the term of this patent is extended or adjusted under 35 U.S.C. 154(b) by 390 days.

(21) Appl. No.: 12/856,974

(22) Filed: Aug. 16, 2010

(65) Prior Publication Data

US 2011/0052435 A1 Mar. 3, 2011

Related U.S. Application Data

(60) Provisional application No. 61/237,335, filed on Aug. 27, 2009.

(51) Int. Cl.
*F04B 19/20* (2006.01)
*F01L 15/16* (2006.01)

(52) U.S. Cl.
USPC ..... 417/491; 417/53; 417/254; 92/138; 91/272

(58) Field of Classification Search
USPC ..... 417/535, 536, 490, 491, 512, 513, 417/267, 53, 254; 92/138, 140; 91/272, 273
See application file for complete search history.

(56) References Cited

U.S. PATENT DOCUMENTS

| | | | | | |
|---|---|---|---|---|---|
| 9,746 | A * | 5/1853 | Hartin | 92/13.6 |
| 137,559 | A * | 4/1873 | Morley | 73/249 |
| 245,889 | A * | 8/1881 | Suits | 91/272 |
| 516,503 | A * | 3/1894 | Meyer | 418/186 |
| 1,238,670 | A * | 8/1917 | Holbrook | 417/510 |
| 1,486,827 | A * | 3/1924 | Barnes | 91/251 |
| 1,839,611 | A * | 1/1932 | Stafford | 60/372 |
| 3,266,432 | A * | 8/1966 | Wortley | 417/490 |
| 4,212,282 | A * | 7/1980 | Apanovitch | 123/204 |

* cited by examiner

*Primary Examiner* — Devon Kramer
*Assistant Examiner* — Nathan Zollinger
(74) *Attorney, Agent, or Firm* — Weiss & Moy, P.C.; Jeffrey D. Moy

(57) ABSTRACT

A plate pump assembly for pumping various fluids including heavy crude. The plate pump assembly includes first and second chambers each having lower and upper valves. Primary upper and lower eccentric cams within the plate pump assembly are connected to an upper plate and a lower plate. A secondary eccentric cam is connected to a piston that separates the first and second chambers. A drive shaft of the assembly rotates the primary upper and lower eccentric cams to actuate the upper and lower plates alternately concealing and revealing the lower and upper valves for the first and second chambers. The drive shaft further rotates the secondary eccentric cam to actuate the piston alternately decreasing and increasing an area of the first and second chambers to receive fluids through the lower valves and compress the area within the first and second chambers to push the fluids through the upper valves.

17 Claims, 9 Drawing Sheets

PLATE PUMP ASSEMBLY FOR USE WITH A SUBSURFACE PUMP

REFERENCE TO RELATED APPLICATIONS

This application claims priority to U.S. Provisional Application Ser. No. 61/237,335 titled PLATE PUMP ASSEMBLY FOR USE WITH A SUBSURFACE PUMP that was filed on Aug. 27, 2009 by Michael Brent Ford and is hereby incorporated in its entirety.

TECHNICAL FIELD

The present application generally relates to fluid pumping apparatuses and, more particularly, to a plate pump assembly for use with a subsurface pump that allows the pumping of solids along with fluids.

BACKGROUND

Fluid that is pumped from the ground is generally mixed with solid impurities such as sand, pebbles, limestone, and other sediment and debris. Certain kinds of pumped fluids, such as heavy crude, tend to contain a relatively large amount of solids. Because of these impurities, a number of problems are regularly encountered during fluid pumping operations.

Solid impurities can be harmful to a pumping apparatus and its components for a number of reasons. Conventional gear pumps, for example, are particularly susceptible to wear and damage from solid impurities that become entrained in the pump components during pumping operations. These solid impurities can cause damage, reduce effectiveness, and sometimes require a halt to pumping operations and replacement of the damaged components. In conventional gear pumps fluid is pumped using an upward and downward motion only, which requires more strength and force than a side-to-side motion. The exertion that conventional gear pumps undergo causes wear and tear on the gear pumps, eventually resulting in pump failure over time and a need for replacement pump components or a replacement pump altogether. This can be both time consuming and expensive.

Conventional rotary and reciprocating pumps that use gear, cams, and fins to move fluid are not efficient and become damaged when pumping high solids fluid. Most pumps of these designs use a rotary motion to move fluid. Rotation of fluid can create a centrifugal motion which causes solids to move outward to the outer regions of the pump wall. With this type of design, solids can be swept to the outer wall where they accumulate as high density slurry. The slurry can then be swept in a rotation motion where there is clearance between the pump components. This clearance can allow the concentration of solids to be forced into areas of tolerance causing abrasive damage to the rotor and stator. This damage can cause more tolerance and thus allow less fluid to be pumped at a given rpm. The solids can also cause the pump to seize and result in the pump being pulled out of service. This cost can be significant when the pump is in critical areas of fluids production.

The present application addresses these problems encountered in prior art pumping systems and provides other, related advantages.

SUMMARY

This summary is provided to introduce a selection of concepts in a simplified form that are further described below in the DESCRIPTION OF THE APPLICATION. This summary is not intended to identify key features of the claimed subject matter, nor is it intended to be used as an aid in determining the scope of the claimed subject matter.

In accordance with one aspect of the present application, a pump assembly is provided. The pump assembly can include an upper plate and a lower plate. In addition the pump assembly can include at least one chamber having a lower valve and an upper valve. The pump assembly can also include a piston positioned within the at least one chamber. The pump assembly can include a drive shaft actuating the upper plate and the lower plate side-to-side alternately opening and closing the lower valve and the upper valve of the at least one chamber. The drive shaft can further actuate the piston positioned within the at least one chamber alternately increasing an area of the at least one chamber when receiving fluid through the lower valve and decreasing the area of the at least one chamber when pushing the fluid through the upper valve.

In accordance with another aspect of the present application, a method for pumping fluids by a plate assembly is provided. The method can include actuating a primary upper cam and a primary lower cam causing an upper plate and a lower plate to slidably move in a side-to-side direction that alternately conceals and reveals upper ports contained within an upper valve region and lower ports contained within a lower valve region in at least one chamber. In addition, the method can include actuating a secondary upper eccentric cam and a secondary lower eccentric cam causing a piston to move in a side-to side direction alternately increasing an area within the at least one chamber for receiving fluid from the lower ports and decreasing the area within the at least one chamber for compressing the received fluid to dispel through the upper ports.

In accordance with yet another aspect of the present application, an apparatus for regulating the pumping of fluids is provided. The apparatus can include a first chamber and a second chamber having lower valves and upper valves. In addition, the apparatus can include a primary upper eccentric cam and a primary lower eccentric cam connected to an upper plate and a lower plate. The apparatus can also include a secondary eccentric cam connected to a piston. The apparatus can include a drive shaft rotating the primary upper and lower eccentric cams actuating the upper and lower plates alternately concealing and revealing the lower and upper valves for the first and second chambers. The drive shaft can further rotate the secondary eccentric cam to actuate the piston alternately increasing an area of the first and second chambers when fluids are received through the lower valves and decreasing the area within the first and second chambers to push the fluids through the upper valves.

BRIEF DESCRIPTION OF DRAWINGS

The novel features believed to be characteristic of the application are set forth in the appended claims. In the descriptions that follow, like parts are marked throughout the specification and drawings with the same numerals, respectively. The drawing figures are not necessarily drawn to scale and certain figures can be shown in exaggerated or generalized form in the interest of clarity and conciseness. The application itself, however, as well as a preferred mode of use, further objectives and advantages thereof, can be best understood by reference to the following detailed description of illustrative embodiments when read in conjunction with the accompanying drawings, wherein:

DESCRIPTION OF THE APPLICATION

Figure 1:
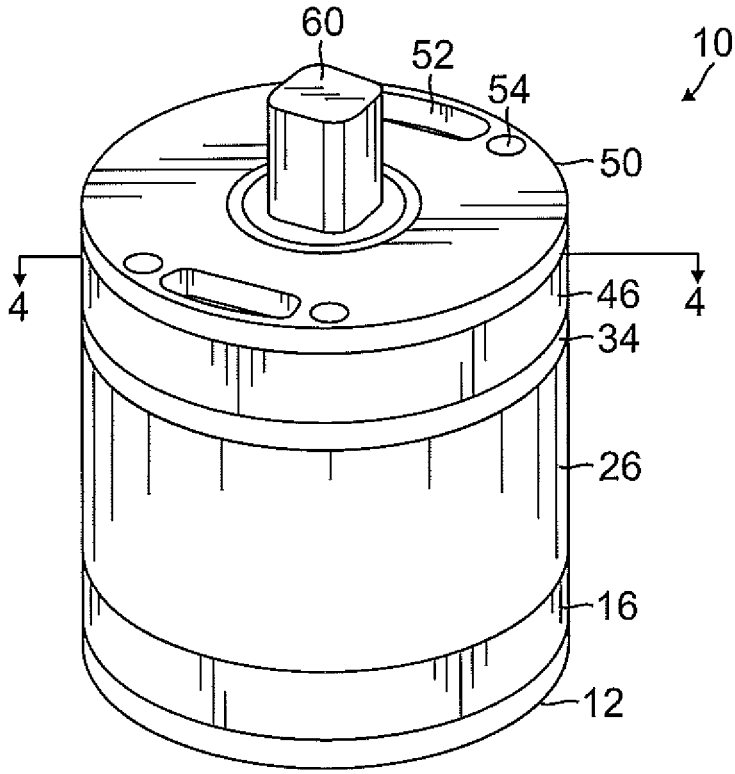
FIG. 1 is a perspective view of an exemplary plate pump assembly, consistent with an embodiment of the present application.

The foregoing description is provided to enable any person skilled in the relevant art to practice the various embodiments described herein. Various modifications to these embodiments can be readily apparent to those skilled in the relevant art, and generic principles defined herein can be applied to other embodiments. Thus, the claims are not intended to be limited to the embodiments shown and described herein, but are to be accorded the full scope consistent with the language of the claims, wherein reference to an element in the singular is not intended to mean "one and only one" unless specifically stated, but rather "one or more." All structural and functional equivalents to the elements of the various embodiments described throughout this disclosure that are known or later come to be known to those of ordinary skill in the relevant art are expressly incorporated herein by reference and intended to be encompassed by the claims. Moreover, nothing disclosed herein is intended to be dedicated to the public regardless of whether such disclosure is explicitly recited in the claims.

Generally described, the present application relates to fluid pumps and associated systems and, more particularly, to a plate pump assembly that can be adapted to operate in conjunction with a subsurface or other type of pump and provide enhanced pumping of various fluids as well as solid impurities that can be contained within certain types of fluids, such as heavy crude. In one illustrative embodiment, the plate pump assembly can include a first chamber and a second chamber with each chamber having a lower valve and an upper valve. Within the plate pump assembly, a primary upper eccentric cam and a primary lower eccentric cam can be provided. The primary upper eccentric cam and primary lower eccentric cam can be connected to an upper plate and a lower plate. Secondary lower and upper eccentric cams within the plate pump assembly can be connected to a piston that separates the first and second chambers.

The plate pump assembly can include a drive shaft. In operation, the drive shaft can rotate the primary upper eccentric cam and the primary lower eccentric cam to actuate the upper plate and the lower plate alternately concealing and revealing the lower valves and the upper valves for the first and second chambers. In addition, the drive shaft can further rotate the secondary lower and upper eccentric cams to actuate the piston alternately decreasing and increasing an area of the first and second chambers. When receiving fluids through the lower valves the area within the first or second chambers can be increased. The area within the first or second chambers can then be decreased to push the fluids through the upper valves. As will become apparent from the discussion below, the processes can be repeated to regulate fluid pumping.

In the embodiment provided above, typically the area within the first chamber increases when the area in the second chamber decreases. Alternatively, the area within the first chamber decreases and the area in the second chamber increases. When the area of a chamber increases, the chamber's upper valve is closed and the lower valve is opened to draw in fluid. The fluid can then be released when the lower valve is closed and the upper valve is opened allowing the fluid within the chamber to pass therethrough. By using the rotational movement of the drive shaft, instead of up and down motions used by conventional pumps, the plate pump assembly can remove the wear and tear caused by solid impurities when pumping fluids.

Typically, the plate pump assembly described herein is designed to be used in areas containing fluids with a large number of solids. The plates in the pump can transfer fluid without placing the fluid in a centrifugal motion. The plates can slide upon each other creating a tighter seal by the lapping motion created during the sliding of the plates on each other. The fluid can be moved upwards to the point of transfer by staging of plates. The fluid solids remain static as to their current state thus allowing the transfer of fluid and solids without causing additional damage the wall of the pump. The plates are synonymous to the rotor in placing the fluid in motion but unlike the rotor, the plates can transfer the fluid thru each stage of the pump without forcing the solids out of suspension into high density slurry. The wear can be minimized to create a pump that has long term pump efficiency. The plate pump can have a positive displacement so it can be operated at a low rpm without loss of efficiency.

The plate pump has the ability to pump larger particles of solids and high density fluid because of its open chamber design. The plate pump allows high density solids to move thru each chamber without being forced into a rotary motion of close tolerance pump components. The plates can be stacked upon each other utilizing the hydrostatic pressure to create a tighter seal among the plates thus creating better long term efficiency. While one embodiment of the plate pump assembly was described above, those skilled in the relevant art can appreciate that numerous other embodiments exist and are within the scope of the present application.

Figure 2:
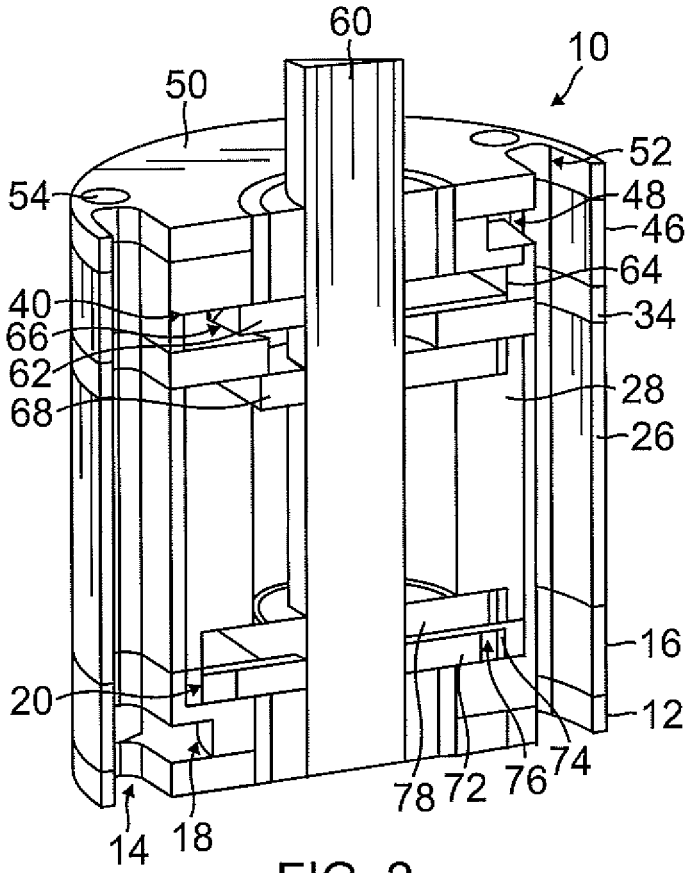
FIG. 2 is a perspective, first cross-sectional view of the exemplary plate pump assembly of FIG. 1.
Figure 3:
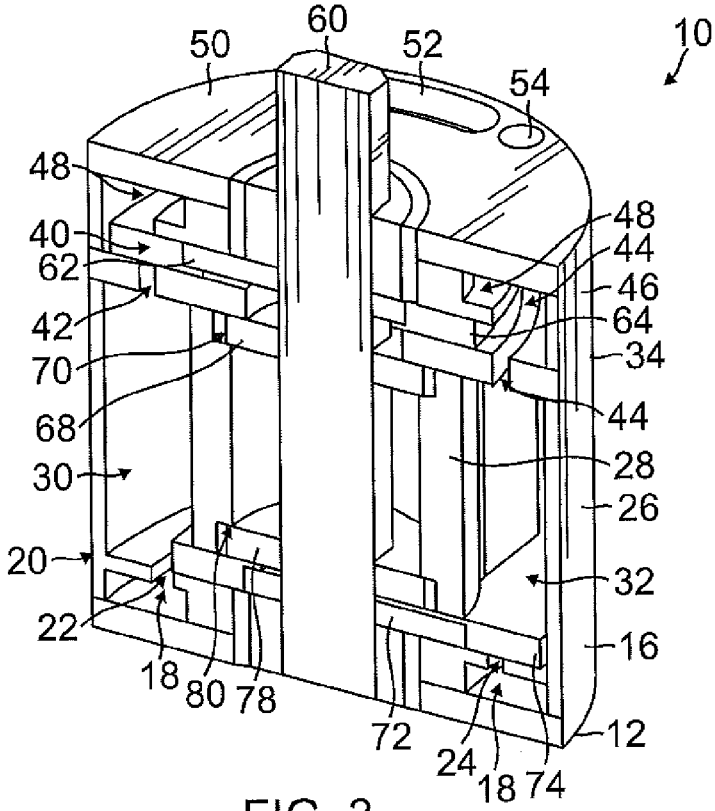
FIG. 3 is a perspective, second cross-sectional view of the plate pump assembly of FIG. 1.
Figure 14:
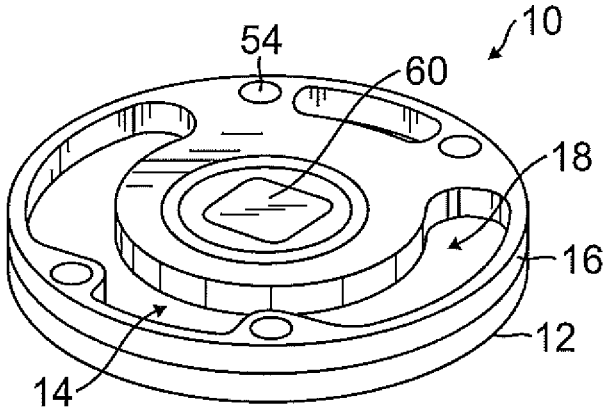
FIG. 14 is a perspective, cross-sectional view of the exemplary plate pump assembly, taken through line 14-14 of FIG. 13.

Referring to FIGS. 1-3, a plate pump assembly 10 consistent with an embodiment of the present application is shown. The plate pump assembly 10 can also be referred to herein, but is not limited to, as a plate pump, pump assembly, or pump. Beginning with the main components of the plate pump 10, and starting at the bottom thereof, a lower disk 12 forms a base for the plate pump 10. Situated directly above the lower disk 12 can be a lower easing 16 which is shown in FIGS. 2 and 3, for example. In one embodiment, the lower casing 16 can house a lower accumulator region 18 and a lower valve region 20. The lower accumulator region 18 is preferably substantially horseshoe-shaped, as shown in FIG. 14.

Figure 4:
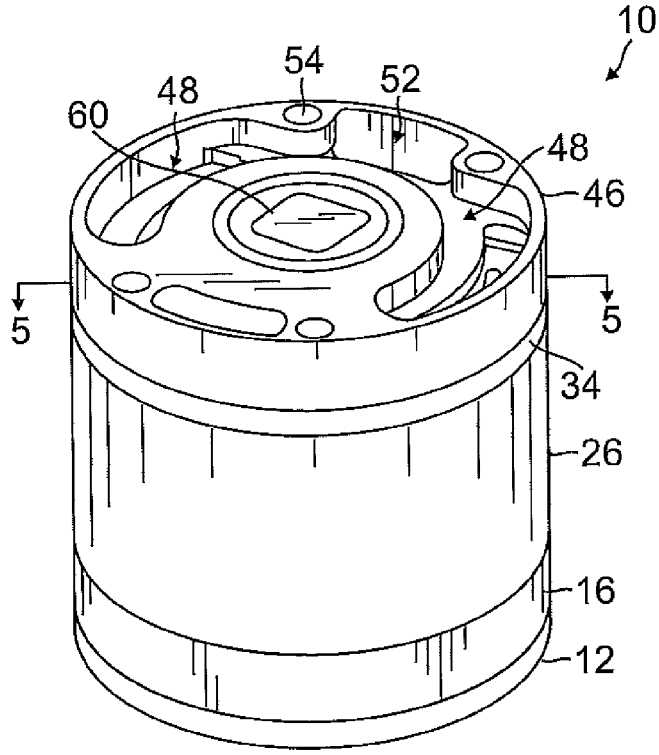
FIG. 4 is a perspective, cross-sectional view of the exemplary plate pump assembly, taken through line 4-4 of FIG. 1.
Figure 5:
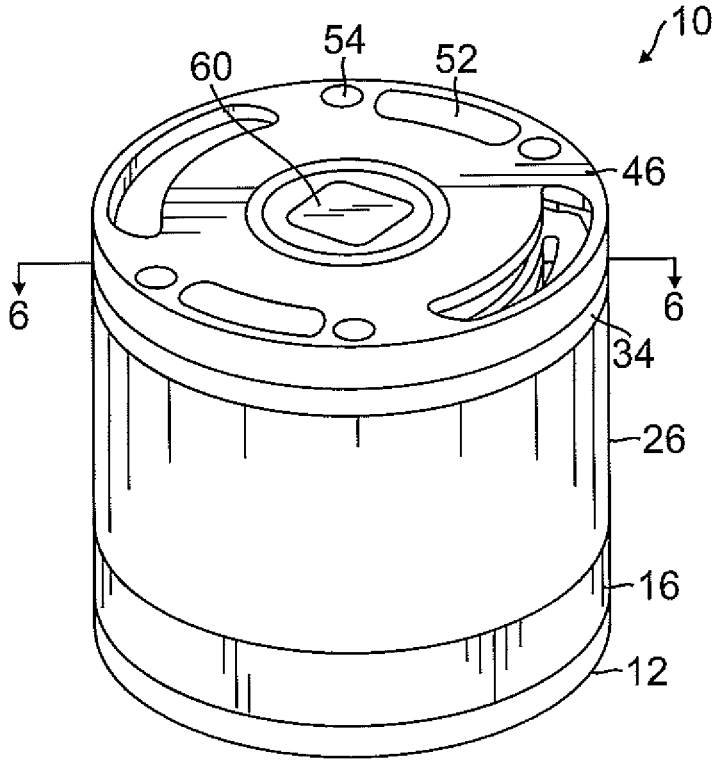
FIG. 5 is a perspective, cross-sectional view of the exemplary plate pump assembly, taken through line 5-5 of FIG. 4.
Figure 6:
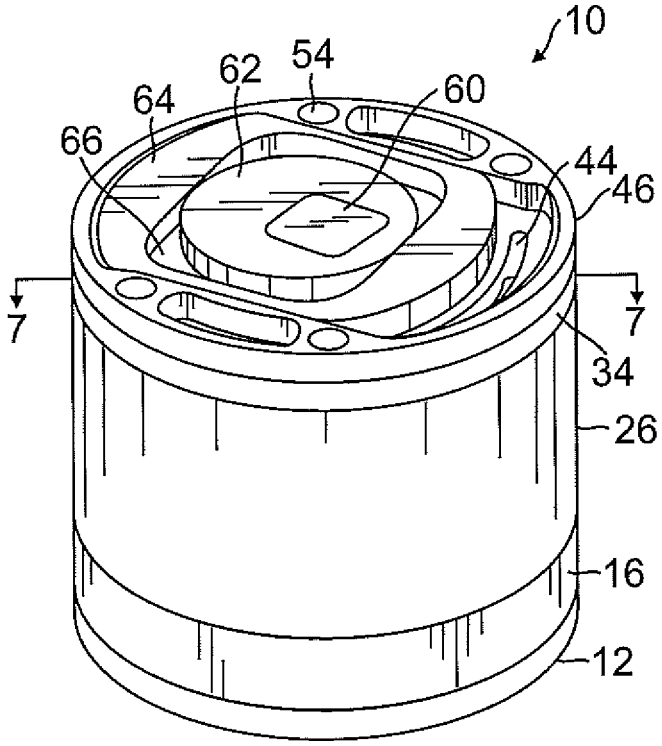
FIG. 6 is a perspective, cross-sectional view of the exemplary plate pump assembly, taken through line 6-6 of FIG. 5.

A middle casing 26 can be situated above the lower casing 16, and house a piston 28, which is shown in FIGS. 2 and 3, for example. Continuing upward, upper casings 34 and 46 can house an upper valve region 40 and an upper accumulator region 48, respectively and as shown in FIGS. 2 and 3, for example. The upper accumulator region 48 is preferably substantially horseshoe-shaped, as shown in FIG. 4. Preferably, the lower accumulator region 18 is oriented in a first direction and the upper accumulator region 48 is oriented in a second direction that is opposite that of the lower accumulator region 18, as can be seen by a comparison of FIGS. 4 and 14, for example. An upper disk 50 can form a cap for the plate pump 10. Those skilled in the relevant art will appreciate that the components described above do not necessarily have to be fitted to a particular casing.

Continuing with a summary of the main components of the plate pump 10, an intake port 14 and a discharge port 52 can be positioned opposite one another on the plate pump 10. The plate pump 10 can define a plurality of bolt holes 54 running from the upper disk 50 through the upper casings 46 and 34, middle casing 26, lower casing 16, and the lower disk 12, through which bolts, not shown, can be inserted, such that multiple plate pumps 10 can be coupled together, as further discussed below. While in the shown embodiment, four bolt holes 54 are utilized, it would be possible to provide more than four or fewer than four bolt holes 54 on the plate pump 10.

A drive shaft 60 can run through a central portion of the components of the plate pump 10 and be positioned through primary upper and primary lower eccentric cams 62 and 72 as shown in FIGS. 2 and 3, for example. The drive shaft 60 can be adapted to be rotatably driven by a motor, not shown, which can be powered in a variety of ways known in the art, such as by a surface or subsurface power generating system.

Figure 7:
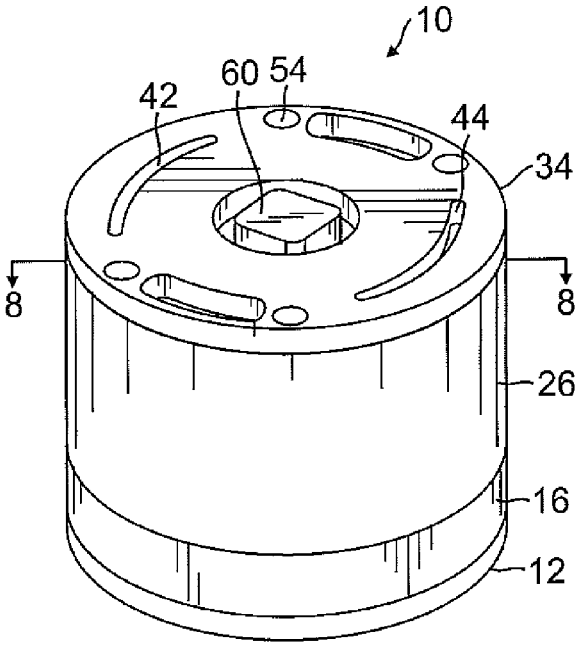
FIG. 7 is a perspective, cross-sectional view of the exemplary plate pump assembly, taken through line 7-7 of FIG. 6.
Figure 13:
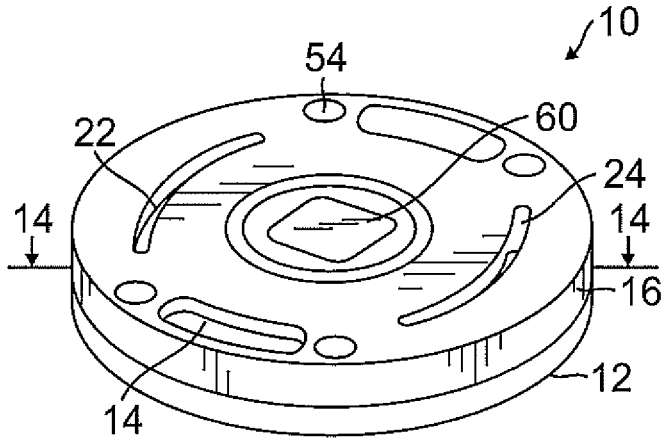
FIG. 13 is a perspective, cross-sectional view of the exemplary plate pump assembly, taken through line 13-13 of FIG. 12.

Referring to FIGS. 6-7 and 10-13, and turning more specifically to the drive shaft 60 and cams 62 and 72, as the drive shaft 60 rotates, it causes the cams 62 and 72 to also rotate. Primary upper cam 62 can be positioned within a depression 66 in upper plate 64, while primary lower cam 72 can be positioned within a depression 76 in lower plate 74. As the cams 62 and 72 rotate within the depressions 66 and 76, they can cause the upper and lower plates 64 and 74 to slidably move. Preferably, and provided within the shown embodiment, the upper and lower plates 64 and 74 move in a side-to-side direction. Known to those skilled in the relevant art, the upper and lower plates 64 and 74 can also move in a circular or semi-circular motion to achieve the same effect. As this occurs, the upper plate 64 can alternately conceal and reveal upper ports 42 and 44 contained within the upper valve region 40, as shown in FIG. 7, for example. Similarly, the lower plate 74 can alternately reveal and conceal lower ports 22 and 24 contained within the lower valve region 20, as shown in FIG. 13, for example. This can create an opening and closing of valves effect, and in conjunction with the operation of the piston 28, as further discussed below, regulate the pumping of fluid through the plate pump 10. Preferably, the cams 62 and 72 are offset from one another, such that in operation, they cause the upper plate 64 and lower plate 74 to slide in opposite side-to-side directions.

Figure 8:
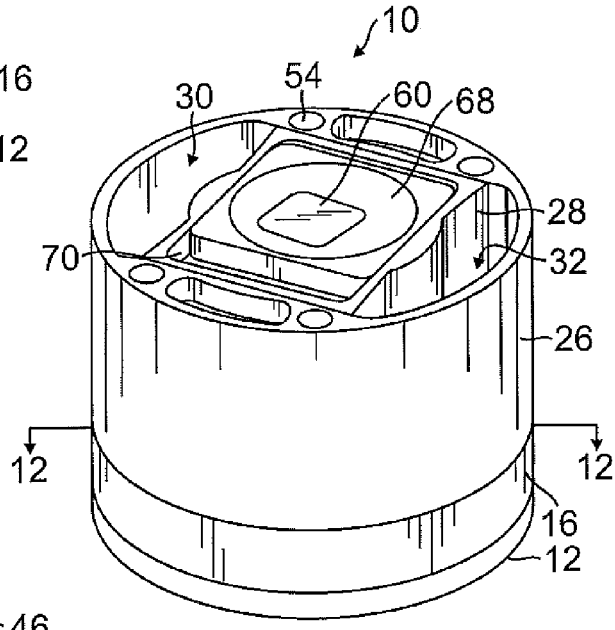
FIG. 8 is a perspective, cross-sectional view of the exemplary plate pump assembly, taken through line 8-8 of FIG. 7.
Figure 9:
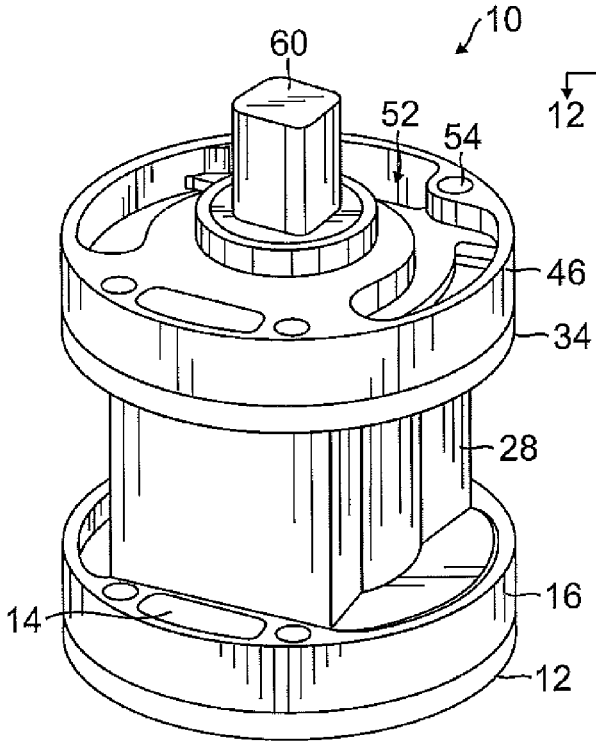
FIG. 9 is a perspective view of the plate pump assembly of FIG. 1, with an upper plate and a casing thereof having been removed.
Figure 10:
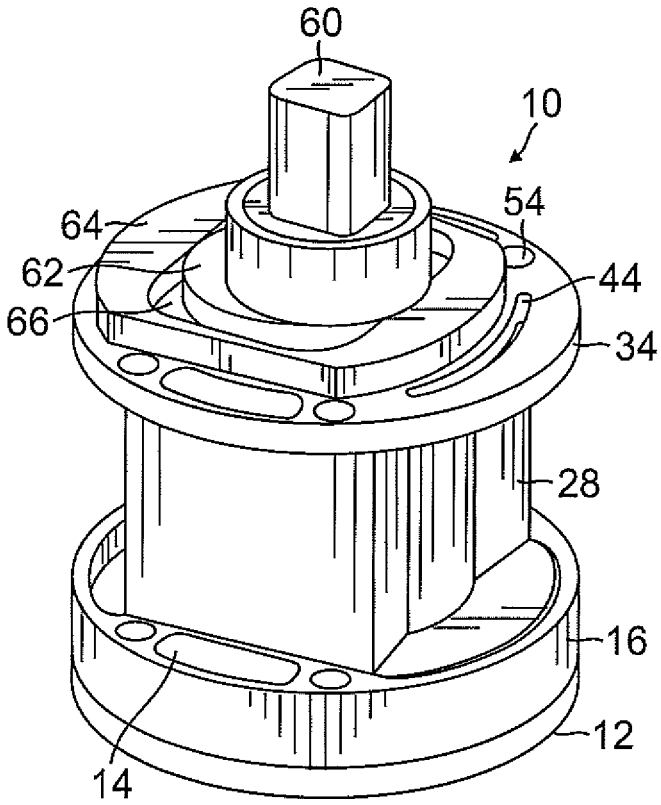
FIG. 10 is a perspective view of the exemplary plate pump assembly of FIG. 9, with an upper common header section thereof having been removed.
Figure 11:
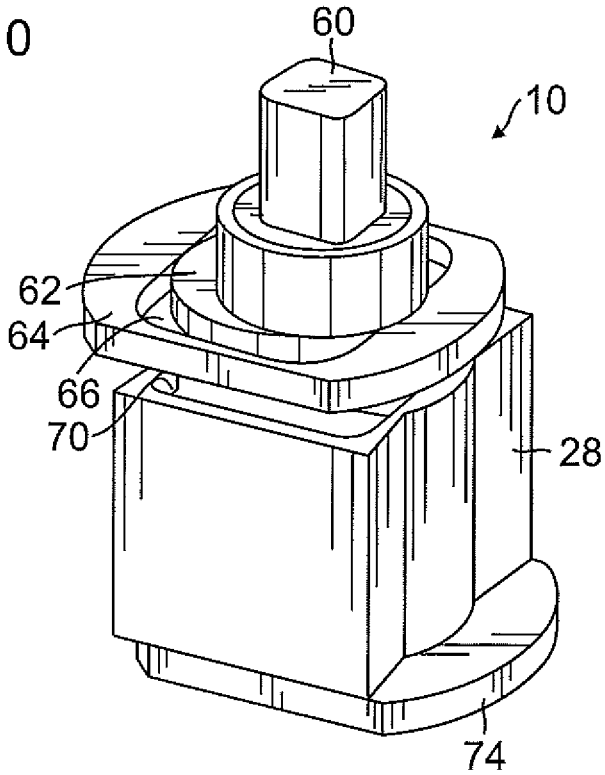
FIG. 11 is a perspective view of the exemplary plate pump assembly of FIG. 10, with a valve section, lower common header section, and lower plate thereof having been removed.
Figure 12:
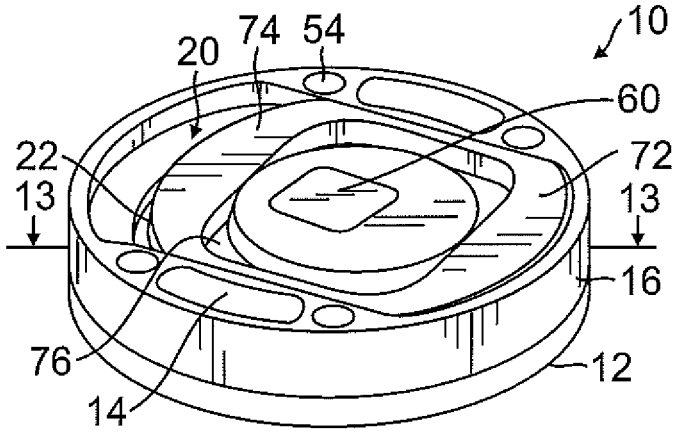
FIG. 12 is a perspective, cross-sectional view of the exemplary plate pump assembly, taken through line 12-12 of FIG. 8.

Referring to FIGS. 2-3 and 8, with respect to the piston 28, as the drive shaft 60 rotates, it also can cause secondary upper and secondary lower eccentric cams 68 and 78 to rotate. Secondary upper cam 68 can be positioned within an upper depression 70 in piston 28, while secondary lower cam 78 can be positioned within a lower depression 80 in piston 28. On opposite sides of the piston 28, situated directly below upper ports 42 and 44, are chambers 30 and 32. As the cams 68 and 78 rotate within the depressions 70 and 80, they can cause the piston 28 to move in a side-to-side direction. Alternatively, and known to those skilled in the relevant art, the piston 28 can move in a circular or semi-circular motion creating the same effect. During pumping operations, this movement of the piston 28 can alternately decrease and increase the area of the chambers 30 and 32, which compresses the fluid within the chambers 30 and 32, causing the fluid to be pushed upwardly through upper ports 42 and 44, thereby regulating the pumping of fluid, as further discussed below.

Figure 15:
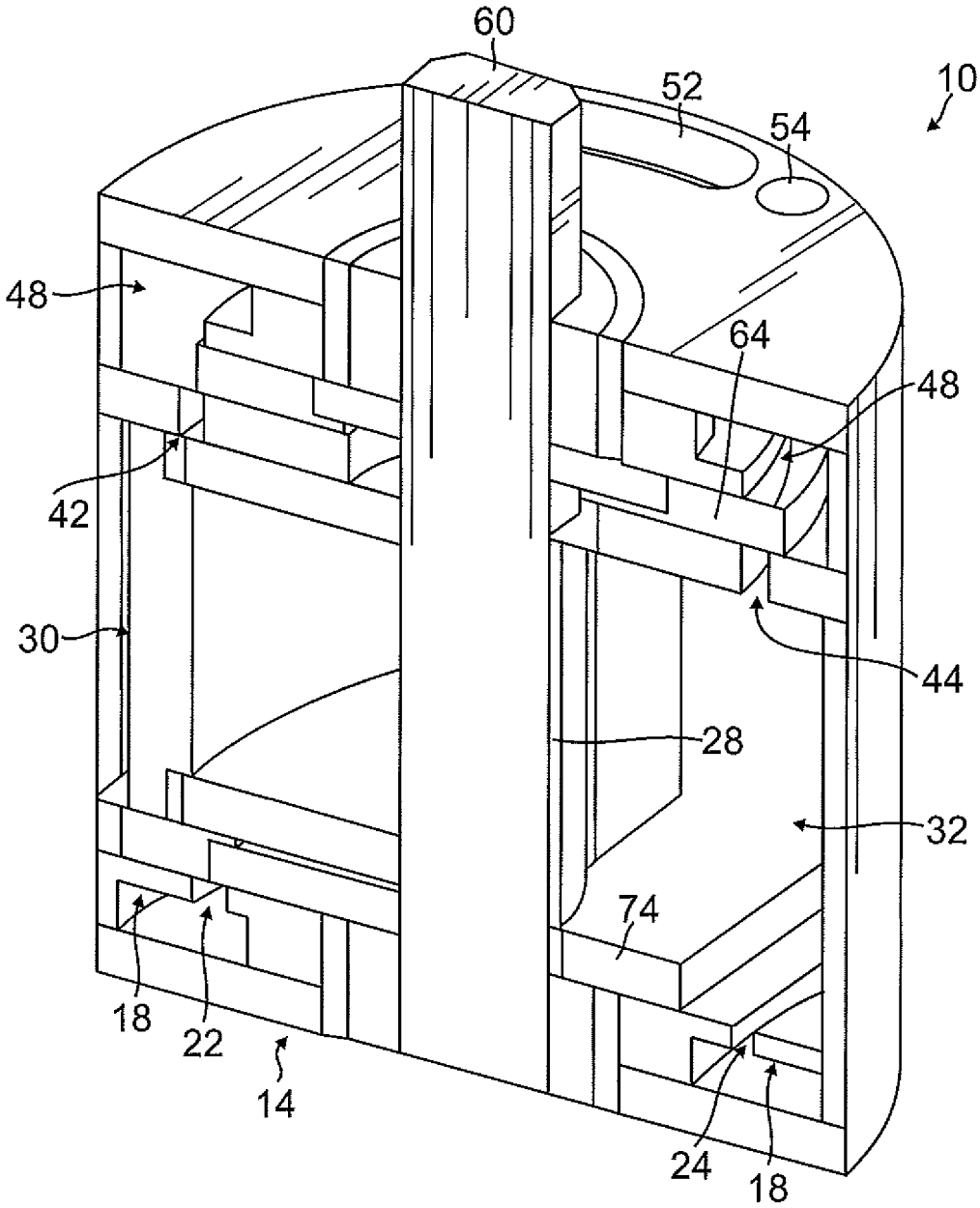
FIG. 15 is a perspective, cross-sectional view of the exemplary plate pump of FIG. 1 showing fluid flow into a chamber.

Fluid flow into and out of the chambers 30 and 32 will now be described. Fluid from a formation typically enters the plate pump 10 at a lower portion thereof through intake port 14. From there, fluid can enter the lower accumulator region 18 as depicted in FIG. 15. The lower accumulator region 18, in one embodiment, can be horseshoe shaped such that the lower ports 22 and 24 can access fluid from the same intake port 14.

When the lower port 22 is concealed by the lower plate 74 lower port 24 is revealed, thereby allowing fluid to be drawn from the lower accumulator region 18 into the lower port 24, where it can then enter the chamber 32 as shown. In addition, upper port 44 can be concealed by upper plate 64. At this time, the piston 28 can be moving in a direction away from the chamber 32 and towards chamber 30. As the piston 28 is moved away, the area of the chamber 32 can increase resulting in more fluid being drawn from the lower accumulator region 18 through port 24.

Figure 16:
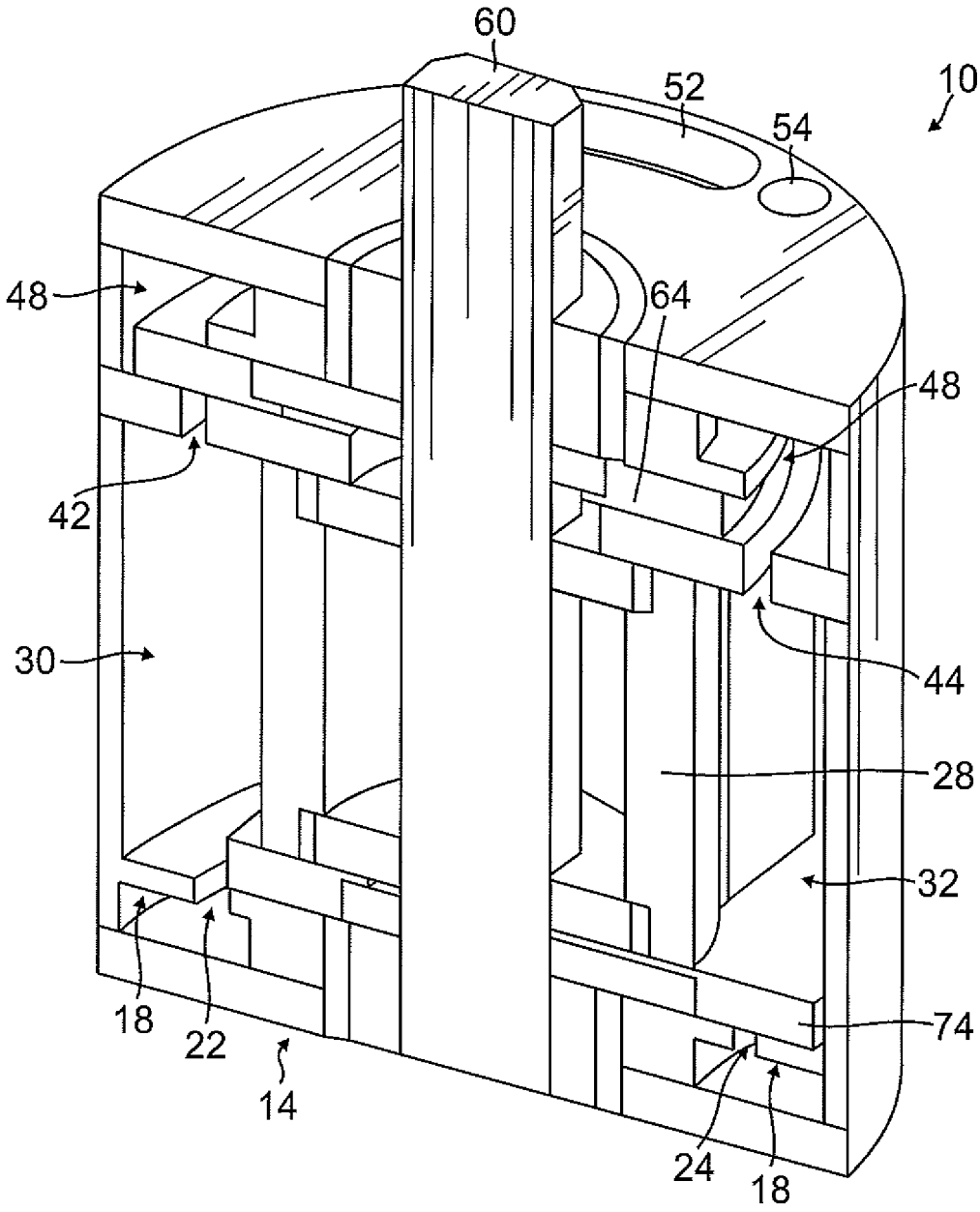
FIG. 16 is a perspective, cross-sectional view of the exemplary plate pump of FIG. 1 showing fluid flow out of the chamber.

Turning now to FIG. 16, as the piston 28 moves back towards chamber 32, the area is decreased. The upper plate 64 moves away from the upper port 44 to reveal the chamber 32. Fluid in the chamber 32 can then be compressed by the piston 28 and forced upward through upper port 44, where it can then enter upper accumulator region 48. To force the fluid through the upper port 44, the lower port 24 is concealed by the lower plate 74.

As shown in FIG. 16 and similar to the process described above, fluid can be drawn from the lower accumulator region 18 into the lower port 22, where it can then enter the chamber 30. Typically, this can occur near or at the time fluid is being pushed from chamber 32. The piston 28 can be moving in a direction away from the chamber 30 increasing its area. In addition, upper port 42 can be concealed by the upper plate 64.

Depicted in FIG. 15, as the piston 28 moves toward chamber 30, the upper plate 64 then moves away from the upper port 42 to reveal it with the lower port 22 being concealed. Fluid in the chamber 30 can be compressed by the piston 28 and forced upward through upper port 42, where it can then enter upper accumulator region 48. Once the fluid has entered the upper accumulator region 48, whether via upper port 42 or upper port 44, it is then drawn through the discharge port 52, where it exits the plate pump 10.

In accordance with the shown embodiment, chamber 30 can receive fluid while chamber 32 dispels the fluid. The upper plate 64 and lower plate 74 can alternate opening and closing the lower port 24 and upper port 44 of chamber 32 and the lower port 22 and upper port 42 of chamber 30. At the same time, the piston 28 can increase the area of the chambers 30 and 32 when drawing in fluid from the lower accumulator region 18 while decreasing the area of the chambers 30 and 32 when dispelling the fluid.

While two chambers 30 and 32 were provided, those skilled in the relevant art will appreciate that the plate pump 10 can have one or many chambers. The plate pump 10 can include a lower port and upper port with each chamber. Each port can be open and closed using the upper plate 64 and lower plate 74 described above. At the same time, the area of the chambers can be increased and decreased when pumping fluid through the piston 28.

Figure 17:
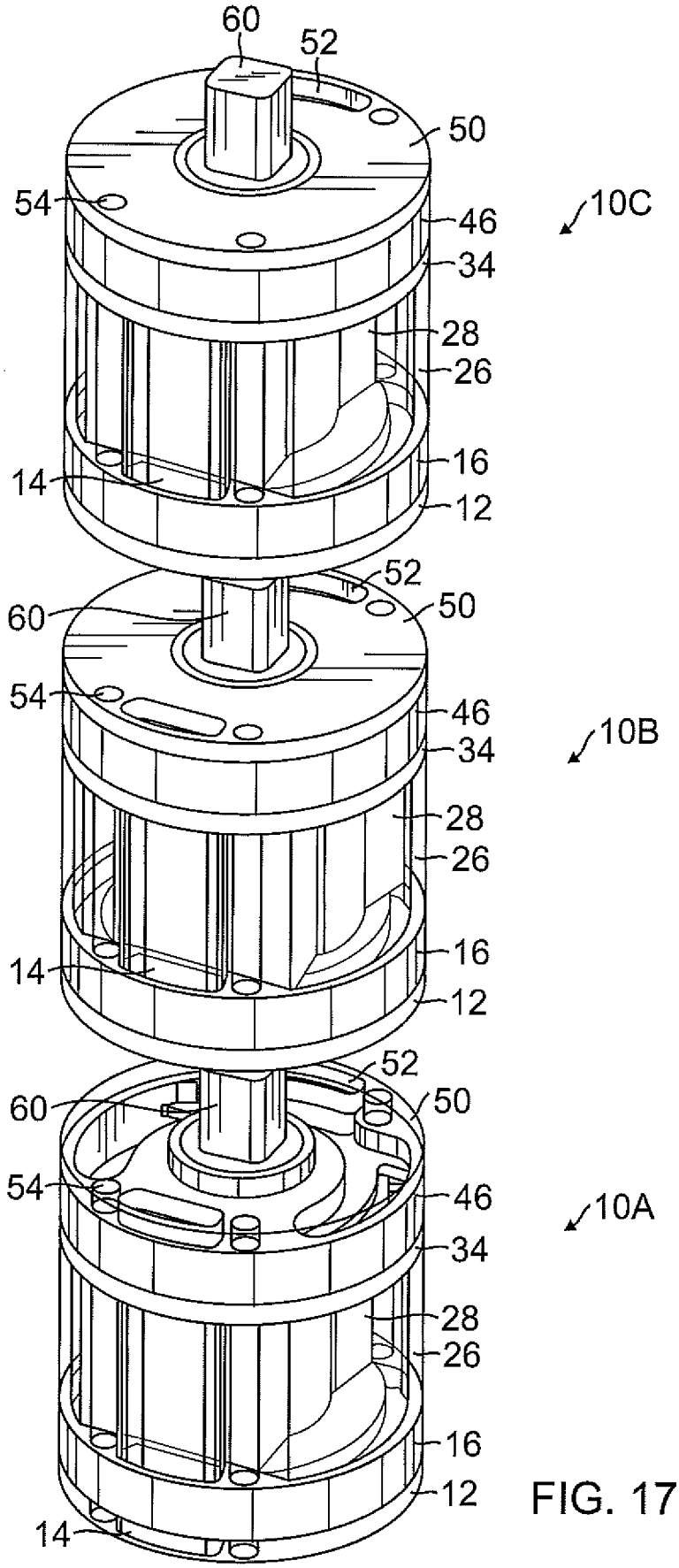
FIG. 17 is a perspective view of a plurality of exemplary plate pump assemblies, consistent with an embodiment of the present application, with portions thereof shown in phantom.

In accordance with one embodiment, more than one plate pump 10 can be provided for use with a subsurface or other type pump, if desired, to provide for additional pumping of fluid. In such a case, multiple plate pumps 10 can be stacked above one another, as shown, for example, in FIG. 17. In FIG. 17, each plate pump 10 is also designated with a letter—A, B, or C—in order to provide a way to distinguish each plate pump 10 from one another in this discussion. In one embodiment, each plate pump 10 would simultaneously draw fluid from a common source and discharge fluid into a common area. Such a configuration would be designed for parallel pumping applications, wherein each plate pump 10 would preferably pump the same amount of fluid at the same rate and at the same time. In another embodiment, series pumping could be performed. Referring to FIG. 17, in such an embodiment, fluid would be first drawn into a bottom plate pump 10A and pumped therethrough in the manner discussed above, with the exception that upon exiting discharge port 52, the fluid would then enter intake port 14 of plate pump 10B, the next pump in the series. The fluid would then be pumped though plate pump 10B, in the manner discussed above. After reaching discharge port 52 of plate pump 10B, the fluid would then enter intake port 14 of plate pump 10C, the next pump in the series. The fluid would then be pumped through plate pump 10C, in the manner discussed above. After reaching discharge port 52 of plate pump 10C, the fluid would then exit the plate pump 10C. While in FIG. 17, three plate pumps 10 are shown, it would be possible to employ more than three or less than three plate pumps 10 in a series or for parallel pumping, for that matter, depending upon the fluid-pumping needs in a given application.

Compared with conventional gear pumps, the plate pump 10, with its sliding plates 64 and 74 and piston 28 provides for greater efficiency. The drive shaft 60 can be driven at a desired rpm, for example, 100 rpm. While an rpm at this rate can be slower than rpm rates utilized in conventional gear pumps, an rpm at this rate provides for sufficient pumping pressure, and allows a single plate pump 10 to pump hundreds of gallons of fluid per minute. In this regard, the side-to-side motion of the sliding plates 64 and 74 and piston 28, is easier than an upward lifting motion that is typically found on conventional gear pumps, and thus allows more fluid to be pumped over a given period of time compared with conventional gear pumps. In addition, the plate pump 10 allows solids to be pumped along with fluids and, being gear-less, there is no risk of solids becoming stuck in gears, as is often the case with conventional gear pumps. The plate pump 10 is thus a high tolerance pump without requiring the use of gears.

In accordance with one aspect of the present application, a pump assembly is provided. The pump assembly can include an upper plate and a lower plate. In addition the pump assembly can include at least one chamber having a lower valve and an upper valve. The pump assembly can also include a piston positioned within the at least one chamber. The pump assembly can include a drive shaft actuating the upper plate and the lower plate side-to-side alternately opening and closing the lower valve and the upper valve of the at least one chamber. The drive shaft can further actuate the piston positioned within the at least one chamber alternately increasing an area of the at least one chamber when receiving fluid through the lower valve and decreasing the area of the at least one chamber when pushing the fluid through the upper valve.

In one embodiment, the pump assembly can include an upper eccentric cam connected to the upper plate and a lower eccentric cam connected to the lower plate, the upper eccentric cam and the lower eccentric cam rotated by the drive shaft to actuate the upper plate and the lower plate. In one embodiment, the upper eccentric cam and the lower eccentric cam can be offset from one another causing the upper plate and the lower plate to slide in opposite side-to-side directions. In one embodiment, an intake port and a lower accumulator region can be in fluid communication with the lower valve and a discharge port and an upper accumulator region can be in fluid communication with the upper valve.

In one embodiment, the lower accumulator region can be oriented in a first direction and the upper accumulator region is oriented in a second direction that is opposite that of the lower accumulator region. In one embodiment, the lower accumulator region and the upper accumulator region can have a horseshoe shape. In one embodiment, the intake port and the discharge port can be positioned opposite one another on the pump assembly.

In one embodiment, the pump assembly can include a secondary cam connected to the drive shaft for actuating the piston. In one embodiment, the secondary cam can include an upper secondary cam and a lower secondary cam both rotated by the drive shaft to actuate the piston.

In accordance with another aspect of the present application, a method for pumping fluids by a plate assembly is provided. The method can include actuating a primary upper cam and a primary lower cam causing an upper plate and a lower plate to slidably move in a side-to-side direction that alternately conceals and reveals upper ports contained within an upper valve region and lower ports contained within a lower valve region in at least one chamber. In addition, the method can include actuating a secondary upper eccentric cam and a secondary lower eccentric cam causing a piston to move in a side-to side direction alternately increasing an area within the at least one chamber for receiving fluid from the lower ports and decreasing the area within the at least one chamber for compressing the received fluid to dispel through the upper ports.

In one embodiment, the primary upper cam, primary lower cam, secondary upper eccentric cam, and secondary lower eccentric cam can be rotated through a drive shaft centrally positioned within the plate assembly. In one embodiment, receiving the fluid can include opening the lower valve region and closing the upper valve region. In one embodiment, dispelling the fluid can include closing the lower valve region and opening the upper valve region.

In one embodiment, the method can include receiving the fluid through an intake port and channeling the fluid through a lower accumulator region to the lower ports. In one embodiment, the method can include dispelling the fluid through an upper accumulator region and channeling the fluid to a discharge port.

In accordance with yet another aspect of the present application, an apparatus for regulating the pumping of fluids is provided. The apparatus can include a first chamber and a second chamber having lower valves and upper valves. In addition, the apparatus can include a primary upper eccentric cam and a primary lower eccentric cam connected to an upper plate and a lower plate. The apparatus can also include a secondary eccentric cam connected to a piston. The apparatus can include a drive shaft rotating the primary upper and lower eccentric cams actuating the upper and lower plates alternately concealing and revealing the lower and upper valves for the first and second chambers. The drive shaft can further rotate the secondary eccentric cam to actuate the piston alternately increasing an area of the first and second chambers when fluids are received through the lower valves and decreasing the area within the first and second chambers to push the fluids through the upper valves.

In one embodiment, the upper plate and the lower plate slidably can move in a side-to-side direction. In one embodiment, the piston can slidably move in a side-to-side direction. In one embodiment, the secondary eccentric cam can include a secondary upper eccentric cam and a secondary lower eccentric cam. In one embodiment, the apparatus can include a motor rotating the drive shaft.

The foregoing description is provided to enable any person skilled in the relevant art to practice the various embodiments described herein. Various modifications to these embodiments can be readily apparent to those skilled in the relevant art, and generic principles defined herein can be applied to other embodiments. Thus, the claims are not intended to be limited to the embodiments shown and described herein, but are to be accorded the full scope consistent with the language of the claims, wherein reference to an element in the singular is not intended to mean "one and only one" unless specifically stated, but rather "one or more." All structural and functional equivalents to the elements of the various embodiments described throughout this disclosure that are known or later come to be known to those of ordinary skill in the relevant art are expressly incorporated herein by reference and intended to be encompassed by the claims. Moreover, nothing disclosed herein is intended to be dedicated to the public regardless of whether such disclosure is explicitly recited in the claims.

What is claimed is:

1. A pump assembly comprising:

an upper plate and a lower plate;

at least one chamber having a lower valve and an upper valve; a piston positioned within said at least one chamber;

a drive shaft actuating said upper plate and said lower plate side-to-side alternately opening and closing said lower valve and said upper valve of said at least one chamber and further actuating said piston positioned within said at least one chamber alternately increasing an area of said at least one chamber when receiving fluid through said lower valve and decreasing said area of said at least one chamber when pushing said fluid through said upper valve; and an upper eccentric cam connected to said upper plate and a lower eccentric cam connected to said lower plate, said upper eccentric cam and said lower eccentric cam rotated by said drive shaft to actuate said upper plate and said lower plate;

a secondary cam connected to said drive shaft for actuating said piston, wherein said secondary cam comprises an upper secondary cam and a lower secondary cam both rotated by said drive shaft to actuate said piston.

2. The pump assembly of claim 1, wherein said upper eccentric cam and said lower eccentric cam are offset from one another causing said upper plate and said lower plate to slide in opposite side-to-side directions.

3. The pump assembly of claim 1, further comprising an intake port and a lower accumulator region in fluid communication with said lower valve and a discharge port and an upper accumulator region in fluid communication with said upper valve.

4. The pump assembly of claim 3, wherein said lower accumulator region is oriented in a first direction and said upper accumulator region is oriented in a second direction that is opposite that of said lower accumulator region.

5. The pump assembly of claim 4, wherein said lower accumulator region and said upper accumulator region have a horseshoe shape.

6. The pump assembly of claim 5, wherein said intake port and said discharge port are positioned opposite one another on said pump assembly.

7. A method for pumping fluids by a plate assembly comprising:

actuating a primary upper cam and a primary lower cam causing an upper plate and a lower plate to slidably move in a side-to-side direction that alternately conceals and reveals upper ports contained within an upper valve region and lower ports contained within a lower valve region in at least one chamber; and actuating a secondary upper eccentric cam and a secondary lower eccentric cam causing a piston to move in a side-to side direction alternately increasing an area within said at least one chamber for receiving fluid from said lower ports and decreasing said area within said at least one chamber for compressing said received fluid to dispel through said upper ports.

8. The method of claim 7, wherein said primary upper cam, primary lower cam, secondary upper eccentric cam, and secondary lower eccentric cam are rotated through a drive shaft centrally positioned within said plate assembly.

9. The method of claim 7, wherein receiving said fluid comprises opening said lower valve region and closing said upper valve region.

10. The method of claim 7, wherein dispelling said fluid comprises closing said lower valve region and opening said upper valve region.

11. The method of claim 7, further comprising receiving said fluid through an intake port and channeling said fluid through a lower accumulator region to said lower ports.

12. The method of claim 7, further comprising dispelling said fluid through an upper accumulator region and channeling said fluid to a discharge port.

13. An apparatus for regulating the pumping of fluids comprising:

a first chamber and a second chamber having lower valves and upper valves;

a primary upper eccentric cam and a primary lower eccentric cam connected to an upper plate and a lower plate;

a secondary eccentric cam connected to a piston, and a drive shaft rotating said primary upper and lower eccentric cams actuating said upper and lower plates alternately concealing and revealing said lower and upper valves for said first and second chambers and further rotating said secondary eccentric cam to actuate said piston alternately increasing an area of said first and second chambers when fluids are received through said lower valves and decreasing said area within said first and second chambers to push said fluids through said upper valves.

14. The apparatus of claim 13, wherein said upper plate and said lower plate slidably move in a side-to-side direction.

15. The apparatus of claim 13, wherein said piston slidably moves in a side-to-side direction.

16. The apparatus of claim 13, wherein said secondary eccentric cam comprises a secondary upper eccentric cam and a secondary lower eccentric cam.

17. The apparatus of claim 13, further comprising a motor rotating said drive shaft.

* * * * *